US005159874A

United States Patent [19]

Adamski, Jr. et al.

[11] Patent Number: 5,159,874

[45] Date of Patent: Nov. 3, 1992

[54] ALIGNING DEVICE FOR SLEEVE

[75] Inventors: Maximilian Adamski, Jr., Palatine; Stephen Ruderman, Oak Park; Robert G. Tegel, Huntley, all of Ill.

[73] Assignee: Union Special Corporation, Huntley, Ill.

[21] Appl. No.: 578,767

[22] Filed: Sep. 6, 1990

[51] Int. Cl.[5] ..... D05B 1/02; D05B 21/00; D05B 27/04

[52] U.S. Cl. ..... 112/262.3; 112/272; 112/306; 112/320; 112/121.11

[58] Field of Search ..... 112/303, 306, 320, 262.1, 112/121.12, 121.15, 121.11, 272, 275, 277, 262.3; 271/261, 265

[56] References Cited

U.S. PATENT DOCUMENTS

| | | | |
|---|---|---|---|
| 4,181,085 | 1/1980 | Conner, Jr. | 112/121.12 |
| 4,498,404 | 2/1985 | Sadeh | 112/121.12 |
| 4,574,719 | 3/1986 | Balke | 112/272 |
| 4,608,936 | 9/1986 | Ball et al. | 112/306 X |
| 4,836,119 | 6/1989 | Siraco et al. | 112/306 |
| 4,841,889 | 6/1989 | Schips | 112/306 X |
| 4,858,541 | 8/1989 | Ozawa | 112/272 X |
| 4,924,790 | 5/1990 | Kondo et al. | 112/272 |
| 5,018,462 | 5/1991 | Brocklehurst | 112/121.15 X |

*Primary Examiner*—Werner H. Schroeder
*Assistant Examiner*—Paul C. Lewis
*Attorney, Agent, or Firm*—Morgan & Finnegan

[57] ABSTRACT

A method and apparatus for aligning and transporting workpieces from a pickup location to a seaming location on a worksurface. Workpieces are rotated through a user-determinable seaming angle so as to re-position the workpiece for sewing a pure straight/angled seam at the seaming location. The device includes a self-compensation system wherein seaming of the workpiece will commence at the leading edge thereof regardless of the initial position of the workpiece at the pickup location.

14 Claims, 5 Drawing Sheets

ALIGNING DEVICE FOR SLEEVE

FIELD OF THE INVENTION

The present invention relates to a method and apparatus for transporting a pre-hemmed sleeve or other workpiece for processing along an assembly line.

BACKGROUND OF THE INVENTION

Prior to the automation of commercial scale apparel manufacturing lines, the manufacture of garment components for use in a finished article of clothing required numerous hand-implemented processing steps. For example, the manufacture f a finished sleeve for incorporation into a tee shirt required at least three discrete manufacturing steps. First, a sleeve blank had to be cut from a larger piece of material. Next, a hem had to be sewn-finished at one end of the sleeve blank. Finally, the sleeve blank had to be folded and seamed so as to form a finished sleeve ready for sewing onto the tee shirt. Significantly, the sleeve blank had to be manually transported from each manufacturing station.

Manual implementation as above described presents a number of drawbacks. For example, the output of the assembly line is lowered, because the individual machines are often capable of greater output than possible via strict human implementation. Moreover, due to the rapid pace of production, a sleeve blank will be occasionally misaligned by the operator, resulting in a defective garment and waste.

For these and other readily apparent considerations, it is therefore advantageous to automate commercial-scale assembly lines producing apparel components. Prior attempts include the 2800 HSLT Hemmer/-Seamer produced by Union Special Corporation of Chicago Ill., assignee herein. Although the device serves to produce a finished tee shirt sleeve, the machine only produces a seam configuration commonly-known as the straight-curved seam. Although sufficing for some garment applications, for aesthetic and fashion reasons, garment manufacturers increasingly require that sleeves be produced with the commonly-known pure straight/angled seam. Moreover, the degree to which the straight seam is angled varies according to the specific garment contemplated.

Accordingly, it is an object of the present invention to provide an apparatus and method for automating the transport of a component of wearing apparel from one processing station to another processing station.

It is another object of the present invention to provide a method and apparatus to automate the transport of a workpiece, for example, a shirt sleeve, from a hemming station to or through a seaming station so as to enable the processing of a wide range of sizes of workpieces It is yet another object of the present invention to provide a method and apparatus to automate the transport of a workpiece from a hemming station to or through a seaming station so that a pure straight/angled seam may be sewn onto the workpiece.

It is a further object of the present invention to provide a method and apparatus to automate the transport of a workpiece from a hemming station to or through a seaming station so that the device is convertible from producing a pure straight/angled seam to producing a straight-curved seam.

The foregoing specific objects and advantages of the invention are illustrative of those which can be achieved by the present invention and are not intended to be exhaustive or limiting of the possible advantages which can be realized. The invention is not limited to the transport of a workpiece to a seaming station for a seaming operation, so that the principles conveyed herein are applicable to performing numerous other sewing or stitching operations upon a workpiece. Thus, these and other objects and advantages of the invention will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

These and additional objects are met by providing an apparatus and method according to the present invention. In one embodiment, a pre-hemmed sleeve blank, folded in two along a preselected axis, is transported from a pickup station along a worksurface and rotated to a predetermined seam angle. Simultaneously, the sleeve blank is transported to a seaming station where the desired pure/straight angled seam is produced.

The overall device may compensate for variances in the final sleeve positioning prior to seaming, relative to the trimming knife, regardless of the initial position of the sleeve blank on the worksurface. To this end a sewing sensor, in line with a trimming knife along the line of feed, is placed a fixed distance near the seaming head so as to detect the approach of the leading edge of the sleeve.

The device includes a pivoting transport slidingly supported above the worksurface and actuated via a motor, preferably a stepper motor but not so limited. However, any suitable motor/feedback circuit combination may also be employed. Feedback to the motor or other linear drive from the sensor thereby terminates transport of the sleeve blank, relative to the trimming knife, at a predetermined position so as to compensate for sleeve positioning.

The transport includes a plurality of gripping elements, supported on a pivot arm, that serve to engage the sleeve blank against the worksurface so as to impart rotational and directional motion thereto. Conveniently, the gripping elements may be placed so that the pivoting action acts along an average center of gravity for the range of sleeve sizes that may be transported by the device. Rotary inertia is thus kept low because the pivot point is kept near the center of gravity for the pivot arm.

The pivoting transport additionally includes a pivot adjustment lock. This lock allows the operator of the device to manually adjust the angular sweep (seaming angle) of the pivot arm. Alternatively, the seaming angle may be automatically controlled via the system central processing unit (CPU). The pivot adjustment also allows the operator to manually compensate for differently sized or shaped sleeve blanks, thereby rendering the device extremely versatile.

When processing smaller sleeves, the grippers immediately adjoining on either side of the pivot point could be used, the grippers farther away from the pivot point remaining inactive. Pivot moments are thereby maintained at a relatively low level, allowing the device to employ smaller mechanical components. System mass and reflected inertia are also minimized, contributing to the smooth acceleration and deceleration of the pivoting transport, and to the overall accuracy and quality of the finished seam. The reliability of the device is also improved, ensuring process repeatability.

The device may compensate for the longer processing times associated with larger workpieces by slowing the operating speed of the pivoting transport. Significantly, noise levels are reduced, and overall reliability and process reliability of the device is thereby improved.

Also, overall accuracy in seam formation is enhanced by a novel clamping action exerted by a right-hand clamping device located on the pivot arm of the transport device. This novel secondary action serves to remove any gathering or ballooning on the hem just before the hem is transported under the foot of the seamer.

BRIEF DESCRIPTION OF THE DRAWINGS

The invention will be described in greater detail by way of reference to the following drawings, in which.

DETAILED DESCRIPTION OF THE DRAWINGS

Figure 1:
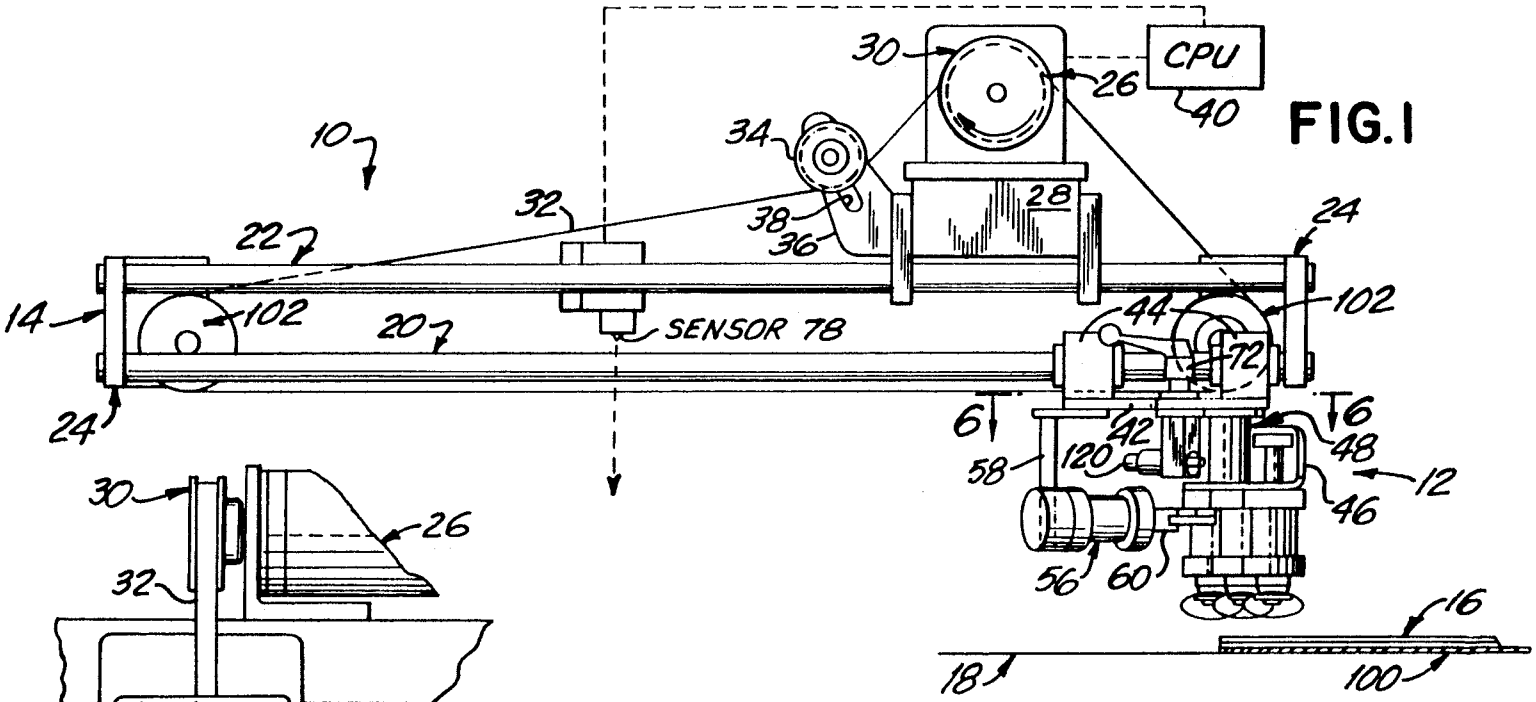
FIG. 1 is a side elevational view of one embodiment according to the present invention illustrating the relationship of the transport assembly, support mechanism and actuating motor.
Figure 2:
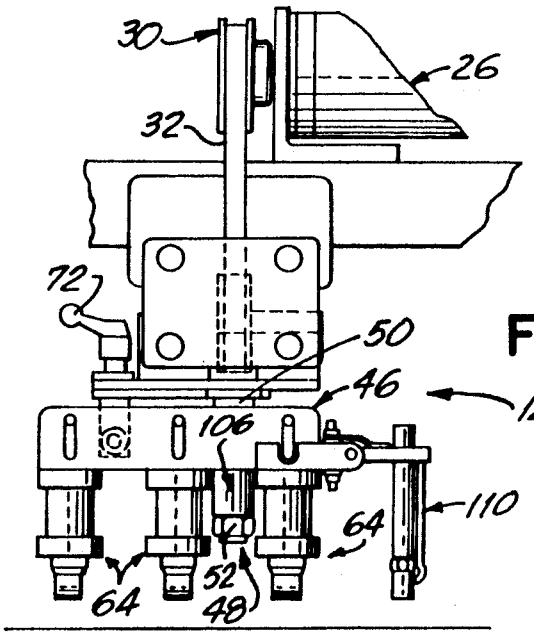
FIG. 2 is a frontal view of a transport assembly according to the invention 1.

Referring now to the drawings, wherein like numerals refer to like components, there is illustrated in FIG. 1 one embodiment of the sleeve transport device 10 according to the invention. The device advantageously includes a pivoting sleeve transport assembly 12 slidingly mounted upon a support assembly 14. Although the illustrated embodiment employs a single transport assembly 12, the invention may include additional transport assemblies corresponding to need or desire, such as, for example, when multiple manufacturing operations may be undertaken upon the sleeve blank 16.

The support assembly 14 can be mounted over a worksurface 18. The worksurface 18 is illustrative of, for example, a seamer table top or other surface over which the sleeve blank 16 will be transported from a designated pickup position upon an indexing table 100 through a plurality of processing positions until the sleeve blank has been seamed. Note that although the transport device 10 according to the invention is being explained in reference to a seaming operation, it is understood that the principles conveyed are applicable to a wide range of garment manufacturing operations which involve the transport and/or rotation of the garment component during processing.

The support assembly 14 includes guide rods 20 positioned over worksurface 18 so as to be parallel to the line of feed. The rods 20 additionally are oriented parallel to one another in a plane parallel to the plane of worksurface 18. Support rods 22 lie in a similar orientation in a plane directly above guide rods 20. The ends of guide rods 20 and support rods 22 are fixedly secured to support plates 24.

Motor 26 is mounted onto support rods 22 via a motor support assembly 28. The motor 26 is commanded by a computer or CPU 40 which controls the operation of the device 10. The motor 26 translates the rotational motion of its drive wheel 30 to linear motion of the transport assembly 12 through a drive belt 32. The drive belt 32 passes around pulleys 102 rotatably affixed at opposite ends of support assembly 14.

The tension in drive belt 32 is conveniently adjusted via a tensioning wheel 34. The axle (not shown) of wheel 34 is releasably supported through a slot 38 in a support plate 36. The end of the axle of wheel 34 may be threadingly secured (not shown) through slot 38 and held fixedly in place via a nut (not shown). The tensioning wheel 34 may thus be positioned along the length of slot 38. As tensioning wheel 34 is in contact with the drive belt 32, positioning the tensioning wheel 34 closer to worksurface 18 increases the tension in belt 32, while positioning the tensioning wheel 34 away from the worksurface 18 will decrease the tension in the drive belt 32.

The various components that make up transport assembly 12 are affixed to a mounting plate 42. The mounting plate 42 itself is slidingly supported to the guide rods 20 via linear bearings 44 affixed to the top surface of the plate 42. Advantageously, drive belt 32 is fixedly secured to the top surface of mounting plate 42, so that transport assembly 12 may be displaced along the guide rods 20, by the motor 26, from the sleeve pickup position over indexing table 100 to the seaming station 104. By reversing the direction of rotation of the drive wheel 30, the direction of displacement of transport assembly 12 may be reversed.

A pivot arm 46 is rotatably attached below the mounting plate 42 via a pivot assembly 48. The pivot assembly 48 may include, for example, a threaded stud 50 affixed at one end to the mounting plate 42. The threaded, free end of stud 50 freely passes down through an elongated, tube-like aperture 106 in the pivot arm 46. Significantly, the tube 106 may be provided with internal, self-lubricating bushings which advantageously eliminate the need for messy lubricants, an important consideration when processing fabrics. The free end of threaded stud 50 is fixedly secured to tube 106 via an elastic lock nut 52 and thrust and spring washers 54. This configuration advantageously allows pivot arm 46 to rotate in the plane of the worksurface 18 about the stud 50.

Rotation of the pivot arm 46 may be actuated by a pneumatic cylinder 56. The cylinder 56 is supported beneath the mounting plate 42 via a cylinder support bracket 58. The sliding piston 60 of the cylinder 56 is affixed at one end of the pivot arm 46 via a linkage mechanism or clevice 62 so that the outward thrust of piston 60 causes the pivot arm 46 to rotate clockwise about the pivot assembly 48 in the plane of worksurface 18; similarly, the retraction of piston 60 into the cylinder 56 causes a counterclockwise rotation of pivot arm 46.

The pivot arm 46 supports a plurality of sleeve gripping assemblies 64. As herein illustrated, three such assemblies 64 are attached to the pivot arm 46, but a greater or fewer number may be contemplated according to need or desire. Where smaller sleeve blanks 16 are processed, one may employ fewer gripping assemblies 64, such as the assemblies 64 immediately adjoining the pivot assembly 48. Thus, the device 10 is rendered versatile, accommodating a range of sizes of shirt sleeve blanks.

Note that at least one such assembly 64 is located inside of the pivot assembly 48, the remaining assemblies 64 located outside of the pivot assembly 48. Advantageously, this configuration contributes to reduced pivot moment and rotary inertia created by the rotation of the pivot arm 46. The performance and accuracy of the transport device 10 is thereby enhanced, because the pivoting transport assemblies 12 can accelerate and decelerate without the influence of extraneous moments or inertia. Also, the radii to the gripping assemblies 64 from the pivot assembly 48 may be configured to a minimum value according to the range of sizes of sleeve blanks 16 contemplated.

Each gripping assembly 64 includes a gripping cylinder 66 longitudinally mounted to the pivot arm 46 so that the sliding piston 68 of the gripping cylinder 66 is free to project perpendicularly towards the plane of worksurface 18. Note that, as herein embodied, the clevice 62 may be affixed to the outermost cylinder 66. However, the clevice 62 may also be affixed to an endpoint of pivot arm 46.

Each gripping assembly 64 may also include an elastic gripper loop 70 or other similar elastic end effector, such as a compression spring, that is affixed to the free end of sliding piston 68. The gripper loop 70, preferably elliptically shaped but not so limited, may be formed from standard belting material or other resilient material that allows the loop 70 to act as a spring, thereby assuring positive retention of the sleeve blank 16 against worksurface 18. The elliptical shape of gripper loops 70 meritoriously allows the gripping assemblies 64 to adjust the degree of retention of the sleeve blank 16 against the surface 18, because the rigidity of the loops 70 will vary depending upon their placement upon sliding piston 68 and their orientation against surface 18.

The outside surface of gripper loops 70 may be roughened so that a frictional force is imparted to the sleeve blank 16 upon the motion of gripping assembly 64, thereby transporting the sleeve blank 16 along the surface 18. Utilizing belting material provides gripper loops 70 with such a roughened surface. However, the gripper loop 70 also serves to isolate the downward force exerted by gripping cylinder 66 so as to prevent excessive frictional force from being imparted to sleeve blank 16.

Advantageously, the pivoting arm 46 may include a sleeve clamping mechanism 110. The clamping mechanism 110 includes a pneumatic cylinder and piston 112 so as to exert a primary clamping, holding action directed against sleeve blank 16 perpendicular to the plane of worksurface 18. The free end of the piston may be tipped with a suitable gripping material 114 such as rubber or conveyor belting.

Figure 5:
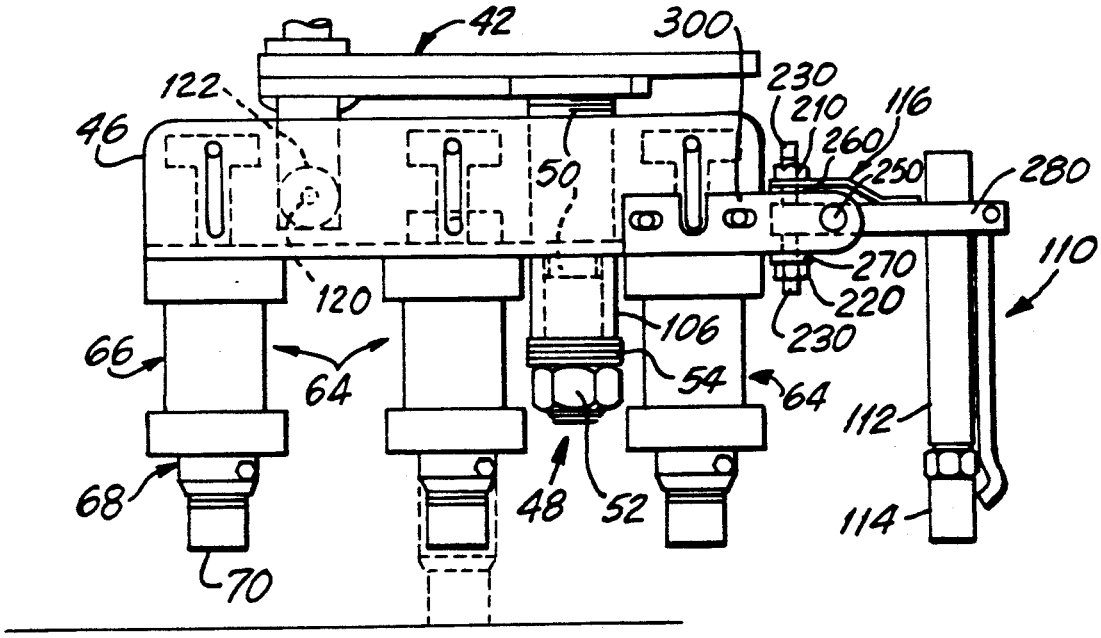
FIG. 5 is a front view of a transport assembly according to the invention showing the right-handed clamp and illustrating the construction of the gripper assemblies and their relationship to their actuating cylinders.
Figure 6:
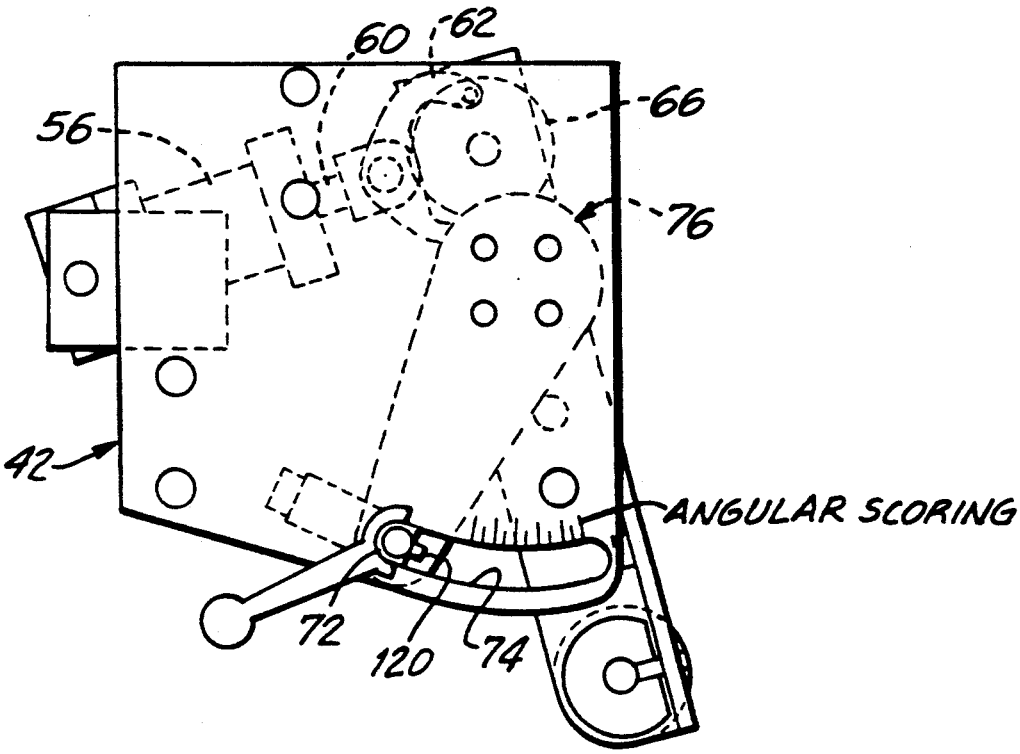
FIG. 6 is a top view of the transport assembly according to the invention showing the pivot lock and pivoting action of the pivot arm.
Figure 7:
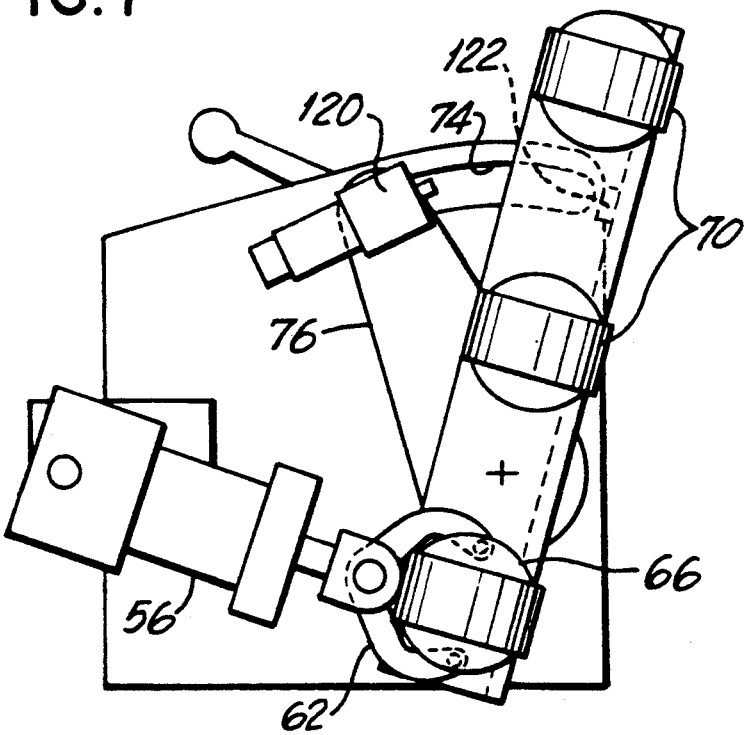
FIG. 7 is a bottom view of the embodiment of FIG. 6.
Figure 8:
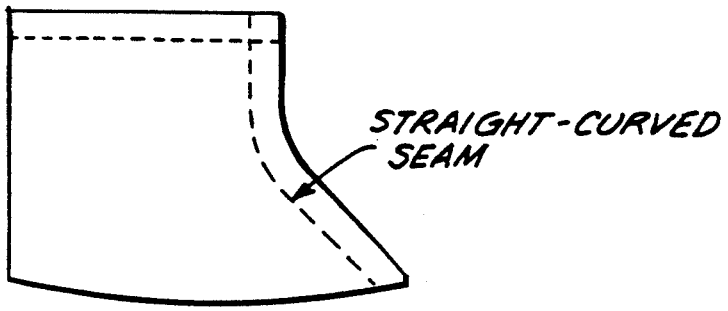
FIG. 8 represents a finished sleeve blank configured with a straight-curved seam.
Figure 9:
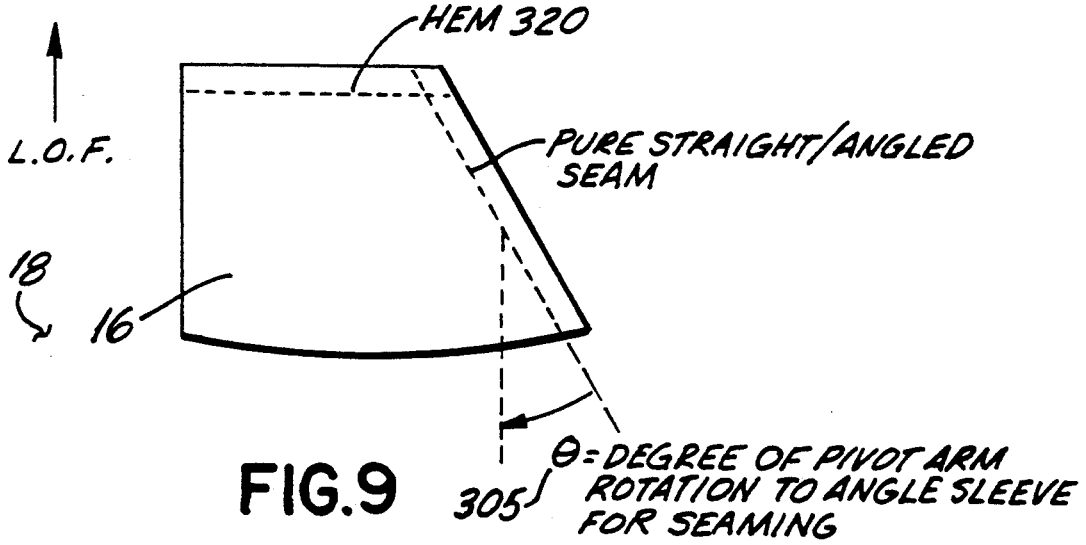
FIG. 9 represents a finished sleeve blank configured with pure straight/angled seam.

The clamping mechanism 110 may also exert a secondary clamping action parallel to the plane of worksurface 18 and directed perpendicular to the line of feed (L.O.F) of sleeve blank 16. This is accomplished by variably rotating cylinder 112 away from or towards pivot arm 46. To this end, clamping mechanism 110 may be provided with a retaining spring 116 and positive stops or adjusting screws 210, 220. The stops 210, 220 are secured upon a respective threaded stud 230. Variably rotating stops 210, 220 upon studs 230 increases (or releases) tension on retaining spring 116 so as to effect rotation of cylinder 112. As illustrated in FIG. 5, a clamping mechanism support bracket 300 is affixed to the pivot arm 46. Piston support bracket 280 rotates about pivot 250 on the clamping mechanism support 300. Each stud 230 is threaded through respective washers 260, 270 affixed to the sides of clamping support 300. The adjusting screws 210, 220, which press against respective washers 260, 270, are each threaded about their respective stud 230. As also illustrated, the retaining spring 116 is affixed, at one end, to the piston support bracket 280, and is threaded at the other end between screw 210 and washer 260. Rotating the screws 210 and 220 causes the studs 230 to be engaged or disengaged, at their free ends, against the piston support bracket 280. Rotating the screws 210, 220 also serves to vary the tension applied to spring 116 order to alter the bias of support bracket 280 about the pivot 250. The degree of outward pivotal motion by bracket 280 is regulated by the spacing between the surface of the bracket 280 and the studs 230. Hence, when the free end 114 of the piston 112 is lowered against the work surface 18, an outward pivotal motion of the free end 114 results, due to the counterclockwise pivot imparted to support bracket 280 about the pivot 250. The degree of outward clamping action applied by the free end 114 can be regulated by the tension applied to the spring 116.

Preferably, the clamping mechanism 110 is rotated outwardly so as to exert slight tension on the sleeve blank 16 at its hemmed portion. This tensioning force is advantageously directed outward from the foot(not shown) of the seaming station 104. This enables the device 10 to reduce or eliminate puckering or gathering of the sleeve material at the hem 320, caused by lint or other extraneous material on worksurface 18, or due to the nature of the material of sleeve blank 16. A tauter, straighter seam is thereby assured. Additionally, reducing puckering lowers the number of instances where a workpiece jams the overall device 10, thereby improving process repeatability.

Rotational pivot of the pivot arm 46 is controlled via a pivot adjustment lock 72. The lock 72, mounted onto an arm 76 rotatably affixed beneath plate 42, is threadingly engaged through an arcuate slot 74 in the mounting plate 42. The arc of slot 74 is substantially co-radial to the radius of movement of the pivot arm 46. Note that the arcuate slot 42 may be scored or marked so as to indicate the rotational displacement of pivot arm 46. The angular rotation of pivot arm 46 may be adjusted from a rotation of 0 degrees (e.g., a straight, tubular sleeve would be produced) to other desired rotation angles, limited in part by the length of arcuate slot 74. The rotation of pivot arm 46 may be configured to produce a user-determinable range of seam angles 305 on sleeve blank 16. Additionally, the operator may compensate for any positional or angular variances of sleeve blank 16.

A shock absorber 120 is affixed to the lower portion of pivot lock 72. The shock absorber 120 strikes a plate 122 affixed to pivot arm 46, thereby halting the rotation of the pivot arm 46 at a pre-designated rotation angle. By releasing the lock 72, one may manually realign the pivot lock 72 in the slot 74 so as to adjust the desired angular rotation of the pivot arm 46 and, consequently, the seam angle produced on sleeve blank 16. Relocking the pivot adjustment lock 72 secures the revised position of the pivot arm 46. Note that this adjustment mechanism further allows the device 10 to process sleeve blanks 16 of varying shapes and sizes, the size and shape characteristics of each sleeve blank 16 dictating the degree of rotation required to properly produce the desired pure straight/angled seam.

Figure 3:
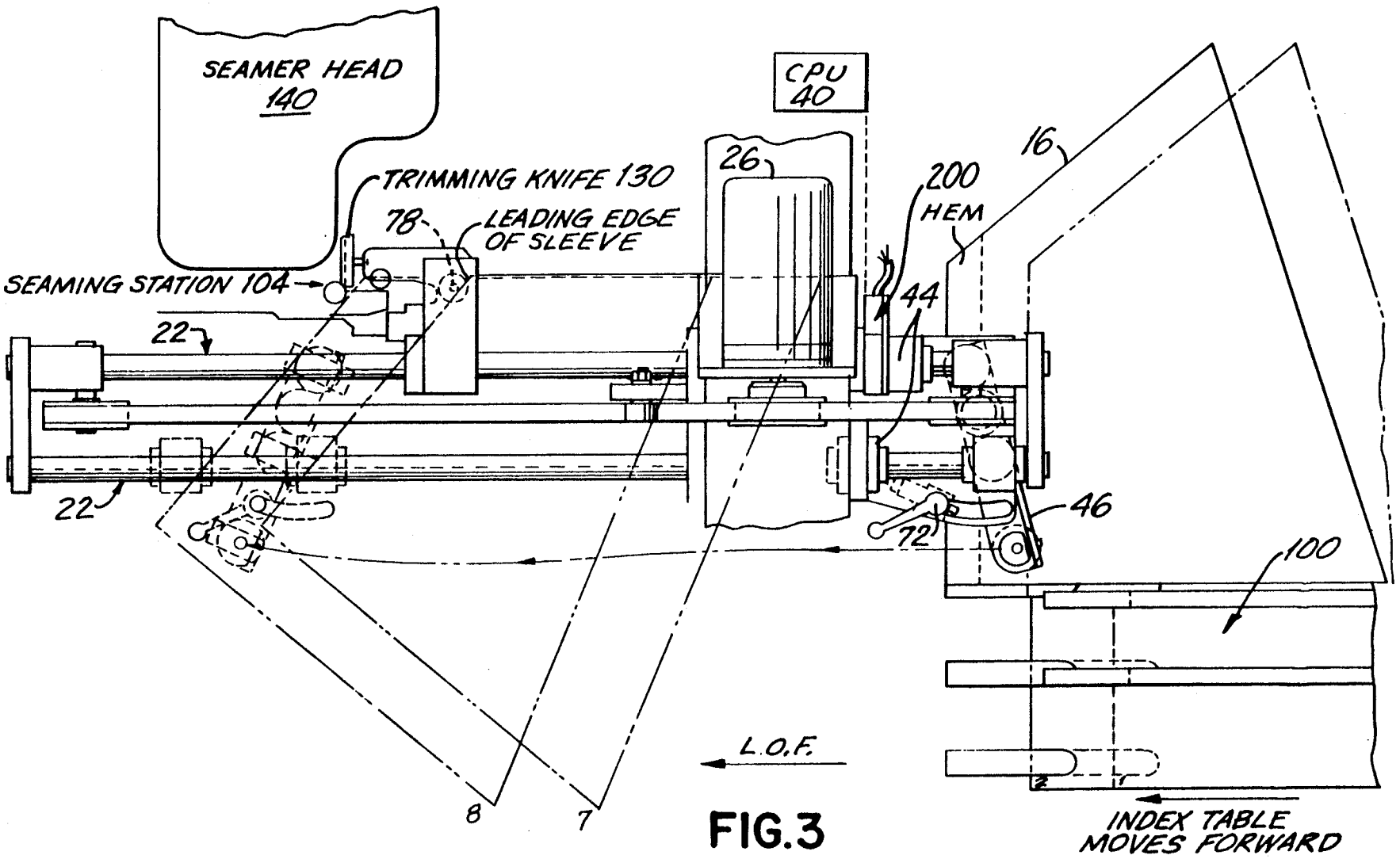
FIG. 3 is a top view of the embodiment of FIG. 1 illustrating the construction of the transport assembly and the position thereof during transport of a prehemmed sleeve blank.
Figure 4:
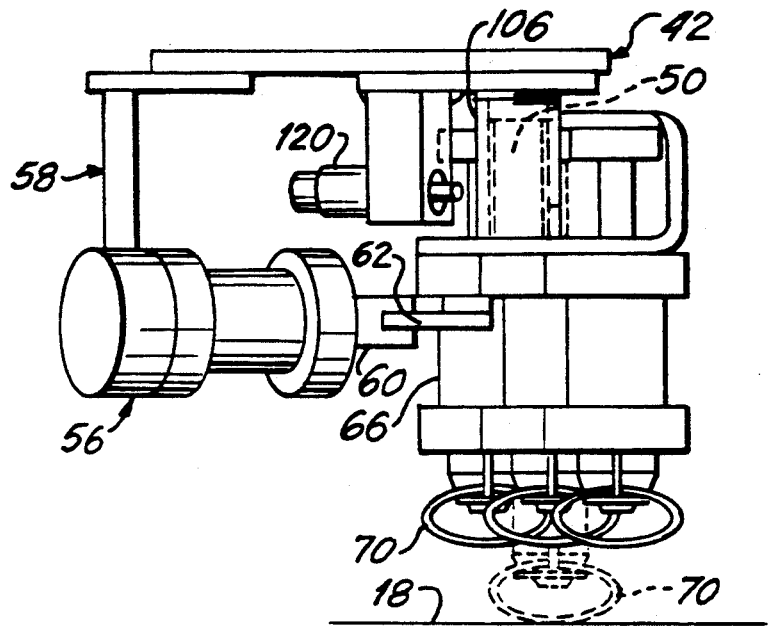
FIG. 4 is a side view of a transport assembly illustrating the relationship of the grippers and actuating cylinder to the pivot point on the pivot arm.

Referring now to FIG. 3, located over worksurface 18 is a sew sensor 78, preferably photoelectric but not so limited. The sensor 78 is located a fixed distance from the trimming knife 130 and is in line with the knife 130 along the line of feed (L.O.F). Advantageously, the sew sensor 78 allows the device 10 to compensate for variances in the final sleeve position relative to the seamer trimming knife regardless of the initial position of the sleeve blank 16 on the indexing table 100, or due to subsequent positional or angular variations that occur as sleeve blank 16 is transported across worksurface 18. This is accomplished by resetting the counter of motor 26 when the leading edge of sleeve blank 16 approaches the knife 130. The sew sensor 78 will reset the counter of motor 26 just before sleeve blank 16 comes into contact with knife 130.

The sew sensor 78 lies a fixed, known distance from the seamer head 140. Thus, the transport of the sleeve blank 16 to the seamer head 140 may be adjusted by the motor 26 so as to compensate for the initial sleeve blank positioning on the indexing table 100. Advantageously, this initial positioning is noted by a sensor 200 (preferably photoelectric but not so limited) located approximately above the indexing table 100, thereby initializing the positioning of the transport assembly 12 and establishing a reference sleeve blank position for sew sensor 78. A feedback system is thereby established between sensors 78, 200, and motor 26 and CPU 40, allowing for the accurate resetting of the counter of motor 26 so as to insure that sewing upon the sleeve blank 16 by the latchtack needle of seamer head 140 will commence precisely at the leading edge of the sleeve. Process repeatability and the quality of the finished sleeve blank 16 is improved, manual intervention being significantly reduced. Alternatively, note that the device 10 may employ any suitable motor/feedback combination that will similarly enact such positional compensation of sleeve blank 16.

The positional sequence for seaming the sleeve blank 16 will be explained. The sleeve blank 16 is subjected to positional changes undertaken by the transport assembly 12 corresponding to displacement along the line of feed (L.O.F.) from a pickup position on the indexing table 100 to final seaming. Additionally, the sleeve blank 16 will undergo a number of rotational displacements in the plane of worksurface 18 as the sleeve blank 16 proceeds from its pickup position to its final, seaming position.

A sleeve blank 16 is initially located on an indexing table 100, corresponding to, for example, the dropoff location of sleeve blank 16 as it emerges from a hemming operation. Note that the sleeve blank 16 may be pre-folded and oriented inside-out so as to be properly oriented for presentation to the seaming station 104. The indexing table 100 moves forward on sliding means (not shown) so as to present sleeve blank 16 for pickup by transport assembly 12.

Transport assembly 12 engages a sleeve blank 16 against the indexing table 100. The gripping cylinders 66 receive a signal from the CPU 40, thereby lowering the elastic gripper loops 70 into engagement with the sleeve blank 16 against the indexing table 100. Note that for smaller sized sleeve blanks 16, only two sleeve gripping assemblies 64 would be necessary, e.g., the gripping assembly inside of the pivot assembly 48 and the one immediately outside thereof.

Referring to FIG. 3, the transport assembly 12 now proceeds to transport the sleeve blank along the line of feed upon the worksurface 18 towards the seaming station 104. Next, the transport assembly 12 is alternately accelerated and decelerated by the motor 26, and the pivot arm 46 is rotated through the predetermined seaming angle, established by pivot lock 72, by the cylinder 56. Advantageously, the clamping mechanism 110 is engaged, exerting a primary clamping action against worksurface 18 and a sleeve tensioning action parallel to worksurface 18 to remove any puckering, ballooning or gathering of the sleeve blank 16 at its hem. The sleeve blank 16 continues to be transported along the line of feed towards the seaming station 104 until the leading edge of the sleeve blank 16 passes the sew sensor 78.

The sleeve has now been rotated through its predetermined seaming angle, and has been substantially decelerated when detected by the sew sensor 78, substantially corresponding to the proper trim and sewing orientation to produce the pure straight/angled seam contemplated by the invention. Note that sew sensor 78 detects the leading edge of the sleeve blank 16, and, as previously explained, provides input to the CPU 40 so that the motor 26 may compensate for variances in the final seaming position of the sleeve blank 16 relative to the trimming knife 130 of the seamer 104 regardless of the initial position of sleeve blank 16 on the indexing table 100, or other positional variances that may arise as sleeve blank 16 travels along worksurface 18.

The sleeve blank 16 is thus transported by transport assembly 12, to the seaming station 104 at a final seaming position. Note that the previous positional compensation assures that seaming will commence at the leading edge of the sleeve blank 16.

Finally, sleeve blank 16 is transported through the seaming station 104 where a pure straight/angled seam is sewn onto the sleeve blank. As embodied, the transport assembly 12 disengages from the sleeve blank 16 prior to the transporting of the sleeve blank 16 through the seaming machine, wherein other means (not shown) such as overhead conveyors engage the sleeve blank to transport it through the seaming station 104. However, the device 10 may be configured so that transport assembly 12 transports the sleeve blank through the seaming machine, such as by extending the length of support assembly 14.

The device 10 may further accommodate varying product processing times (cycle times) via an adjustment in the product transport times. Product transport times (which may be measured from the point of pickup on indexing table 100 to the end of the seaming process) will decrease as the garment size increases, in part to the increased time available for the transport assembly 12 to travel from the point of pickup on indexing table 100 to the seaming station 104. Since for a larger sized sleeve blank 12 the seaming station 104 will require a greater processing time, the larger the size of the sleeve blank 12, the device 10 will compensate by reducing the speed of the transport assembly 12 (such as by slowing the rotational speed of motor 26). Meritoriously, the slower transport speed contributes to the overall repeatability of the process and serves to reduce the dynamic loadings and noise levels while the device 10 is in operation. Hence, the reliability of the device 10 is significantly improved.

Thus, the present device provides a convenient way for transporting upon a worksurface workpieces from a central indexing location to a seaming station or other stitching station, thereby allowing said workpiece to be accurately seamed at a user determinable seam angle, while compensating for any positional or angular variances of the workpiece on the worksurface.

It will be apparent that other and further forms of the invention may be devised without departing from the spirit and scope of the claims, it being understood that this invention is not to be limited to the specific embodiments shown.

We claim:

1. An aligning device for aligning and transporting a workpiece along a line of feed upon a work surface to a seaming machine for sewing a pure straight/angled seam onto said workpiece, comprising:

a central processing unit (CPU) for coordinating operation of said aligning device;

a transport assembly for transporting said workpiece along said line of feed from a pickup point to a seaming point on said worksurface, said transport assembly comprising a plurality of gripping assemblies mounted onto a pivot assembly for rotating said workpiece during transport of said workpiece along said line of feed for subsequent processing at said seaming point;

a support assembly elevated above said worksurface for supporting said transport assembly along said line of feed;

a sensor located upon said worksurface for detecting a leading edge of said workpiece prior to said seaming point, said sensor cooperating with said CPU so that said sewing of said seam will commence at said leading edge; and a motor for actuating motion of said transport assembly along said line of feed.

2. The aligning device according to claim 1, wherein said transport assembly further comprises:

a mounting plated slidingly supported on said support assembly;

said pivot assembly comprises a pivot arm rotatably supported on said mounting plate, said pivot arm rotatable in a plane defined by said worksurface;

an actuating cylinder affixed to said mounting plate for rotating said pivot arm; and said plurality of gripping assemblies are mounted upon said pivot arm to grip said workpiece against said worksurface.

3 The aligning device according to claim 2, wherein said transport assembly further comprises a user adjustable pivot lock for variably pre-setting a degree of rotation of said pivot arm, said pivot lock including a shock absorber for engaging said pivot arm when said preset rotation is achieved so as to prevent further rotation of said pivot arm.

4. The aligning device according to claim 2, wherein said plurality of gripping assemblies comprise:

an actuating cylinder and piston assembly vertically oriented with respect to said worksurface, said piston having a free end; and a spring-like gripping loop affixed to the free end of said piston, said gripping loop engageable against said worksurface so as to engage said workpiece therebetween.

5. An aligning device for aligning and transporting a workpiece along a line of feed upon a worksurface to a seaming machine for sewing a pure straight/angled seam onto said workpiece, comprising:

a central processing unit (CPU) for coordinating operation of said aligning device;

a transport assembly for transporting said workpiece along said line of feed from a pickup location to a seaming point on said worksurface, said transport assembly comprising a plurality of gripping assemblies mounted onto a pivot assembly for rotating said workpiece during transport along said line of feed to orient said workpiece at a preset angular position corresponding to a user determinable angle for said straight/angled seam;

a support assembly elevated above said worksurface for supporting and guiding said transport assembly along said line of feed;

a sensor located upon said worksurface for detecting a leading edge of said workpiece prior to said seaming point, said sensor cooperating with said CPU so that the sewing of said seam will commence at said leading edge; and a motor having a drive belt for actuating motion of said transport assembly along said line of feed.

6. The aligning device according to claim 5, wherein said transport assembly further comprises:

a mounting plate slidingly supported on said support assembly, wherein said drive belt is fixed to said plate so as to impart linear motion to said plate along said support assembly;

said pivot assembly comprises a pivot arm rotatably supported on said mounting plate, said pivot arm rotatable in a plane defined by said worksurface;

an actuating cylinder having a moving piston, said cylinder affixed to said mounting plate and said piston coupled to said pivot arm so as to rotate said pivot arm in the plane of said worksurface; and said plurality of gripping assemblies are mounted upon said pivot arm to grip said workpiece against said worksurface.

7. The aligning device of claim 6, wherein said transport assembly further comprises a user adjustable pivot adjustment lock for variably presetting an angle of rotation of said pivot arm, said pivot lock including a shock absorber for decelerating said pivot arm as said preset angle is approached.

8. A method for forming a pure straight/angled seam on a sleeve workpiece, comprising the following steps:

transporting said workpiece upon an indexing table to a sleeve pickup location;

engaging said workpiece with a sleeve transport against said indexing table at said workpiece pickup location;

transporting said workpiece through interim sleeve positioning locations from said indexing table along a worksurface;

rotating said workpiece to a pre-set angular position corresponding to a user determinable angle for said straight/angled seam while simultaneously transporting said workpiece through said interim sleeve positioning locations on said worksurface and locating said workpiece at a positional compensation position;

compensating positioning of said workpiece for a final sewing position at said positional compensation position;

disengaging said workpiece from said sleeve transport at said final sewing position; and transporting said workpiece from the final sewing position through a seaming machine for forming a pure straight/angled seam on said workpiece.

9. The seaming method of claim 8, wherein said step of compensating the positioning of said workpiece comprises an additional step of resetting the counter of a motor which actuates said sleeve transport so as to compensate for angular or positional variances of said workpiece on said worksurface.

10. The seaming method of claim 9, wherein said step of compensating the positioning of said workpiece further comprises an additional step of detecting the leading edge of said workpiece with a sensor located in line with a trimming knife of said seaming machine so that seaming will commence at the leading edge of said workpiece.

11. An aligning device for aligning and transporting a workpiece along a line of feed upon a work surface to a seaming machine for sewing a pure straight/angled seam onto said workpiece, comprising:

a central processing unit (CPU) for coordinating operation of said aligning device;

a transport assembly for transporting said workpiece along said line of feed from a pickup point to a seaming point on said worksurface, said transport assembly comprising a plurality of gripping assemblies mounted onto a pivot assembly for rotating said workpiece during transport of said workpiece along said line of feed for subsequent processing at said seaming point;

a support assembly elevated above said worksurface for supporting said transport assembly along said line of feed;

a sensor located upon said worksurface for detecting a leading edge of said workpiece prior to said seaming point, said sensor cooperating with said CPU so that said sewing of said seam will commence at said leading edge;

a motor for actuating motion of said transport assembly along said line of feed; and a workpiece clamp mounted to said transport assembly for exerting a clamping force to said workpiece perpendicular to said line of feed.

12. An aligning device according to claim 11, wherein said workpiece clamp comprises:

a mounting bracket for supporting said workpiece clamp to said transport assembly;

a clamping cylinder having a support bracket rotatably affixed to said mounting bracket;

a biasing spring affixed to said clamping cylinder support bracket for biasing rotation of said clamping cylinder support bracket; and adjustment means affixed to said mounting bracket and engageable with said clamping cylinder support bracket and said biasing spring to adjust tension in said biasing spring and to regulate rotation of said clamping support bracket.

13. An aligning device for aligning and transporting a workpiece along a line of feed upon a worksurface to a seaming machine for sewing a pure straight/angled seam onto said workpiece, comprising:

a central processing unit (CPU) for coordinating operation of said aligning device;

a transport assembly for transporting said workpiece along said line of feed from a pickup location to a seaming point on said worksurface, said transport assembly comprising a plurality of gripping assemblies mounted onto a pivot assembly for rotating said workpiece during transport along said line of feed to orient said workpiece at a preset angular position corresponding to a user determinable angle for said straight/angled seam;

a support assembly elevated above said worksurface for supporting and guiding said transport assembly along said line of feed;

a sensor located upon said worksurface for detecting a leading edge of said workpiece prior to said seaming point, said sensor cooperating with said CPU so that the sewing of said seam will commence at said leading edge;

a motor having a drive belt for actuating motion of said transport assembly along said line of feed; and a workpiece clamp mounted to said transport assembly for exerting a clamping force to said workpiece perpendicular to said line of feed.

14. An aligning device according to claim 13, wherein said workpiece clamp comprises:

a mounting bracket for supporting said workpiece clamp to said transport assembly;

a clamping cylinder having a support bracket rotatably affixed to said mounting bracket;

a biasing spring affixed to said clamping cylinder support bracket for biasing rotation of said clamping cylinder support bracket; and adjustment means affixed to said mounting bracket and engageable with said clamping cylinder support bracket and said biasing spring to adjust tension in said biasing spring and to regulate rotation of said clamping cylinder support bracket.

* * * * *

UNITED STATES PATENT AND TRADEMARK OFFICE

CERTIFICATE OF CORRECTION

PATENT NO. : 5,159,874

DATED : November 3, 1992

INVENTOR(S) : Adamski, Jr. et al.

It is certified that error appears in the above-identified patent and that said Letters Patent is hereby corrected as shown below:

On the title page, item (56):

The following references were cited:

U.S. PATENT DOCUMENTS

| | | |
|---|---|---|
| 4,800,830 | 1/89 | Adamski, et al. |

FOREIGN PATENT DOCUMENTS

| | | |
|---|---|---|
| 1,556,867 | 11/79 | United Kingdom |
| 2,115,842 | 9/83 | United Kingdom |
| 1,320,764 | 6/73 | United Kingdom |

Signed and Sealed this

Twenty-first Day of December, 1993

*Attest:*

Bruce Lehman

BRUCE LEHMAN

*Attesting Officer*

*Commissioner of Patents and Trademarks*